US007132044B2

(12) United States Patent
Mank et al.

(10) Patent No.: US 7,132,044 B2
(45) Date of Patent: Nov. 7, 2006

(54) DEVICE THAT COMPRISES RECYCLING TO A SEPARATOR A LIQUID EFFLUENT THAT IS OBTAINED FROM AN ABSORBER AND IS MIXED WITH A FEEDSTOCK

(75) Inventors: Larry Mank, Orgeval (FR); Laurent Watripont, Nanterre (FR); Bruno Domergue, Carrieres sur Seine (FR)

(73) Assignee: Institut Francais du Petrole, Rueil-Malmaison (FR)

( * ) Notice: Subject to any disclaimer, the term of this patent is extended or adjusted under 35 U.S.C. 154(b) by 758 days.

(21) Appl. No.: 10/071,213

(22) Filed: Feb. 11, 2002

(65) Prior Publication Data

US 2002/0127159 A1 Sep. 12, 2002

(30) Foreign Application Priority Data

Feb. 12, 2001 (FR) ..... 01 01840

(51) Int. Cl.
*C10G 5/00* (2006.01)
*B01D 3/00* (2006.01)

(52) U.S. Cl. ..... 208/341; 208/342; 208/358; 208/100; 208/101; 208/105; 96/134; 96/136; 96/142; 422/200; 422/234

(58) Field of Classification Search ..... 96/134, 96/136, 142, 201; 208/59, 89, 340, 341, 208/358, 342; 422/200, 234
See application file for complete search history.

(56) References Cited

U.S. PATENT DOCUMENTS 5,238,555 A * 8/1993 Pappas et al. ..... 208/340
5,326,926 A 7/1994 Rice
5,597,404 A * 1/1997 Domergue et al. ..... 96/134
5,856,604 A * 1/1999 Stine et al. ..... 585/310
6,158,241 A * 12/2000 Erickson ..... 62/613
6,244,070 B1 * 6/2001 Lee et al. ..... 62/620
6,379,533 B1 * 4/2002 Thakkar et al. ..... 208/59
6,712,880 B1 * 3/2004 Foglietta et al. ..... 95/184
2002/0166336 A1 * 11/2002 Wilkinson et al. ..... 62/620
2005/0107480 A1 * 5/2005 Davey et al. ..... 518/726

FOREIGN PATENT DOCUMENTS

EP 0488757 A1 6/1992
WO 95/23835 9/1995

* cited by examiner

*Primary Examiner*—N. Bhat

(57) ABSTRACT

A device comprising at least one absorber, at least one cold separator from which is extracted a gaseous phase that feeds the absorber, at least one recycling to said cold separator of at least a portion of liquid effluent that is obtained from the absorber and which is mixed with the feedstock, at least one heat exchanger for cooling the mixture prior to the recycling, at least one conduit for recovering a light hydrocarbon-enriched liquid fraction obtained from the cold separator and at least one conduit for evacuating gases from the absorber, said device being useable for the treatment of a hydrogen-rich gas or for the recovery of a hydrocarbon-enriched liquid.

17 Claims, 1 Drawing Sheet

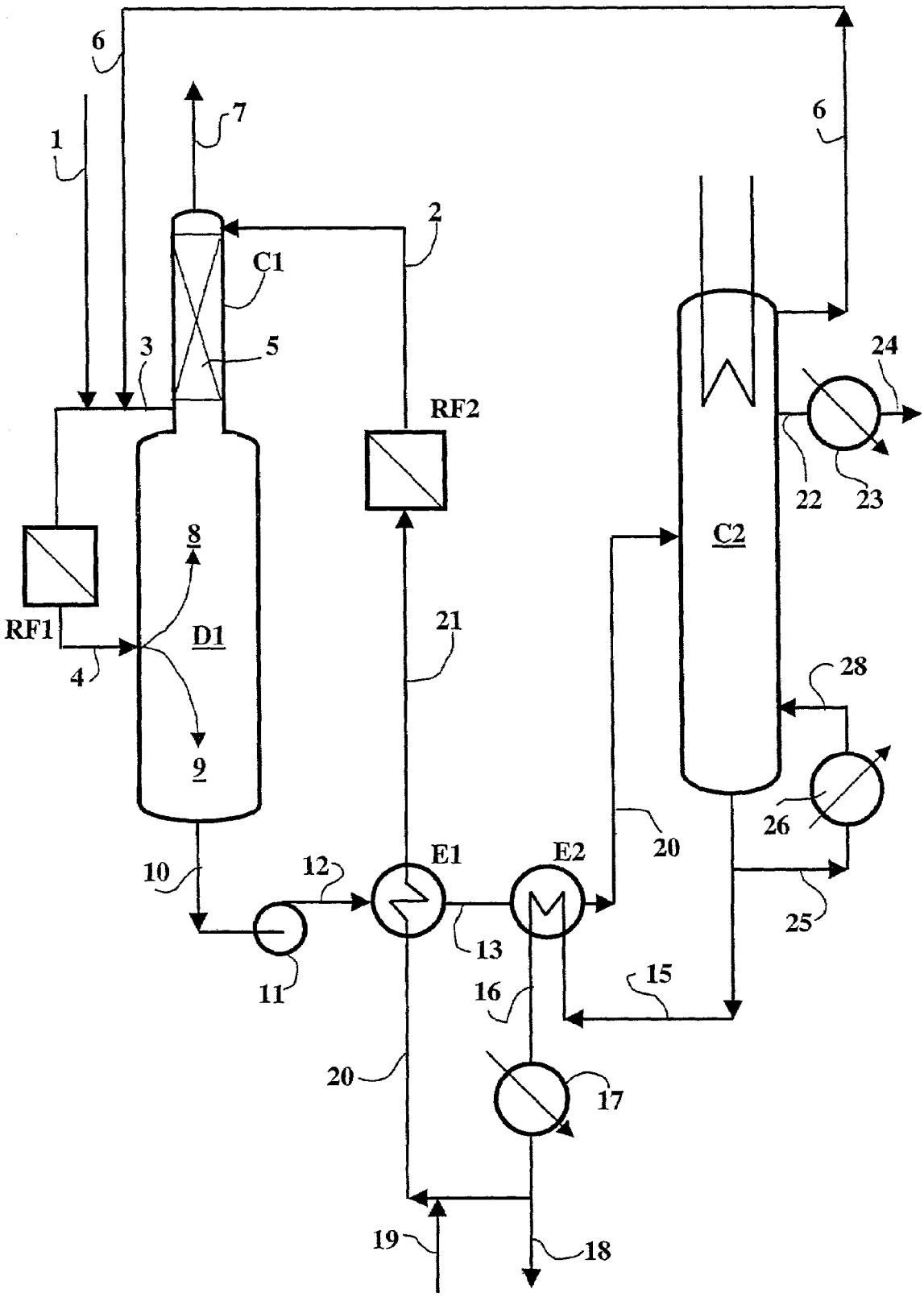
6
7
1
2
C1
3
5
RF2
24
22
23
C2
8
RF1
D1
21
4
9
28
26
20
10
12
E1
E2
25
13
11
15
16
20
17
19
18

DEVICE THAT COMPRISES RECYCLING TO A SEPARATOR A LIQUID EFFLUENT THAT IS OBTAINED FROM AN ABSORBER AND IS MIXED WITH A FEEDSTOCK

The invention relates to a device allowing the recovery of light hydrocarbons, for example hydrocarbons that have a number of carbon atoms of between 2 and 6 (C2 to C6 hydrocarbons), in particular hydrocarbons that are obtained from a petroleum fraction and that are called Liquefied Petroleum Gas or LPG (according to English terminology), essentially comprising C3 and C4 hydrocarbons optionally with a few C2 and/or C5 hydrocarbons. The invention also relates to a device for recovery of a hydrogen-enriched gas. Any gas that comprises hydrogen and light hydrocarbons can be treated in the device according to the invention, for example the purge gases that are obtained from units for conversion of petroleum fractions or from fractions that are obtained from natural gas.

The invention also relates to the processes for recovery of light hydrocarbons or a hydrogen-enriched gas that uses a device according to the invention.

BACKGROUND OF THE INVENTION

U.S. Pat. No. 5,326,926 describes a process for isomerization of C4–C6 paraffins and for recovery of LPG-type hydrocarbons, essentially C4 hydrocarbons. This process comprises an isomerization followed by a stabilization column that produces a separation of the effluent obtained from the isomerization unit into 4 fractions and a stripping of one of the intermediate fractions to collect hydrocarbons that have 4 carbon atoms. This process does not include an absorption column.

Patent EP 0 488 757 B1 describes a process for isomerization of a flow that comprises C5–C6 hydrocarbons. Said process comprises an isomerization zone, a deisohexanization zone that provides at the top methyl and dimethylbutane and normal pentane that are sent to a selective adsorption unit in which the normal hydrocarbons are adsorbed, a lateral fraction comprising normal hexane and methyl pentanes recycled for isomerization and a fraction comprising hydrocarbons with a boiling point higher than that of normal hexane. A desorption stage allows recovery of normal hydrocarbons that are recycled in the isomerization unit. This process comprises adsorption and desorption stages, preferably by variation of pressure with a P.S.A. (Pressure Swing Adsorption according to English terminology, i.e., adsorption by pressure variation) but does not include an absorption stage. It no longer comprises a cooling stage and is optimized for separating the normal paraffins from isoparaffins after isomerization.

U.S. Pat. No. 5,238,555 describes a process for purification of hydrogen by treatment of an effluent containing hydrocarbons and hydrogen and obtained from a hydrocarbon conversion unit. This process comprises a fractionation of the effluent into a liquid phase and a vapor phase, followed by an indirect exchange in a gas/gas exchanger with a hydrogen-rich gas as far as the vapor phase is concerned and an exchange with a hydrocarbon-containing liquid as far as the liquid phase is concerned. The two liquid and vapor flows are then cooled in two separate cooling zones, then sent independently to said absorption unit that operates in countercurrent.

SUMMARY OF THE INVENTION

The invention relates to a device and a process for recovery of light hydrocarbons in a gas or a mixture of gas and liquid, for example in a gaseous fraction that is obtained from a natural gas or a petroleum fraction, or in a purge gas from a hydrocarbon conversion unit such as, for example, a unit for hydrogenation, hydrotreatment, hydroconversion, isomerization or cracking. The invention also relates to a process and a device for recovery of a hydrogen-enriched gas.

In general, the device according to the invention comprises at least one absorber, at least one cold separator from which is extracted a gaseous phase that feeds the absorber, at least one recycling to said cold separator of at least a portion of the liquid effluent that is obtained from the absorber and is mixed with the feedstock, at least one cooling means (or system) of said recycling, at least one means for recovery of a light hydrocarbon-enriched liquid fraction that is obtained from said cold separator and at least one means for evacuating gases from the absorber. Furthermore, the gaseous fraction that emanates from the absorber is high in hydrogen when a conversion unit that functions in the presence of hydrogen is used upstream from the separation device according to the invention. The optimization of operating conditions and the sizing of the equipment therefore makes it possible to use the device according to the invention for the production of a hydrogen-rich gas and/or for the production of a light hydrocarbon-enriched liquid.

The separator is preferably located under the absorber, and more preferably the separator and the absorber consist of two sections that are superposed inside the same piece of equipment. For example, in the device according to the invention, it is preferably possible to use a separator tank (Flash tank according to English terminology) that is surmounted by a column whose height and diameter are adjusted based on the targeted application and the composition of the feedstock. Said column is preferably at least partially filled by bulk packing systems, for example so-called Rachig rings or packing rings that are marketed by the PALL Company (PALL rings), or else using more structured packing such as that produced by the SULZER Company (SULZER packing). Such equipment comprising a separator (D1) surmounted by an absorber (C1) with internal packing (5) is shown in FIG. 1.

According to a preferred variant, the device according to the invention further comprises recycling of the liquid fraction obtained from the separator and at least one cooling means (or system) as part of said recycling.

In addition to all of the means described above and according to other variants, the device according to the invention optionally can comprise cooling systems that are preferably conventional, such as, for example, those using at least one water coolant or at least one coolant gas and/or a fractionation column allowing fractionation of the liquid effluent obtained from the cold separator into at least two fractions, preferably at least 3 fractions, one of which constitutes, at least in part, the liquid phase recycled to the absorber.

It is also optionally possible to recover directly a portion of the liquid effluent obtained from the absorber without recycling this portion to the cold separator.

The device according to the invention can optionally further comprise at least one exchanger allowing exchange of calories between the liquid phase that is obtained from the cold separator and the liquid phase that is recycled to the absorber after fractionation in the column. The different liquid flows can also comprise at least one pump helping in the recirculation of at least one liquid flow. These variants can be combined and are then particularly well suited to the case where the feedstock treated in the device according to the invention is obtained from an isomerization unit.

The effluent enriched with light hydrocarbons with the device according to the invention is collected either directly at the outlet of the cold separator or at a lateral outlet of the fractionation column when the latter is present.

BRIEF DESCRIPTION OF THE DRAWING

FIG. 1 exhibits an embodiment of the device according to the invention.

The entire disclosures of all applications, patents and publications, cited above or below, and of corresponding French application No. 01/01.840, filed Feb. 12, 2001, is hereby incorporated by reference.

EXAMPLES

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius; and, unless otherwise indicated, all parts and percentages are by weight.

In this example, vapor phase 8 of cold separator D1 passes in countercurrent through an absorber C1 where it comes into contact with a lean solvent 2 (i.e., a liquid that is low in light hydrocarbons) that is first cooled in cooling system RF2. Absorber C1 preferably contains a solid 5 that facilitates the absorption, such as, for example, Rachig rings.

The rich solvent or liquid obtained from the absorber and enriched with light hydrocarbons that absorbed light hydrocarbons 3 is mixed with purge gases 1 (feedstock) and 6 (recycling of column C2), in which it is desired to recover said light hydrocarbons.

This mixture is cooled in refrigeration system RF1 before joining separator tank D1 located at the bottom of the absorber. Gaseous phase 8 of separator D1 that is low in light hydrocarbons feeds the bottom of absorber C1. Liquid phase 9 of separator D1 containing the light hydrocarbons is directed via line 10 and with pump 11 and line 12 to a thermal exchanger E1, then via line 13 into exchanger E2, then finally via line 20 to separation column C2, in which the light hydrocarbons are separated from the rich solvent to be recovered at the top of the column via line 22 and cooled in cooler 23 to obtain the light hydrocarbon-enriched liquid phase in liquid form in 24. Column C2 shown in FIG. 1 comprises at the top an internal condensation system. This system optionally can be replaced by external recycling and an external condenser.

The bottom of column C2 consists of the regenerated lean solvent that is recycled to absorber Cl. This recycling is carried out successively via line 15, thermal exchanger E2, line 16, cooler 17, line 20, exchanger E1, line 21, cooling system RF2 and finally line 2.

It is optionally possible and preferred to eliminate via line 18 a portion of the lean solvent and to mix a liquid fraction, fed via line 19, with the lean solvent fraction recycled to the absorber. This liquid fraction can be, for example, a fraction that is obtained from a deisohexanizer, a kerosene, a gas oil, a heavy reformate (heavy fraction that is obtained from a reforming unit) or else a heavy naphtha.

The bottom of the column is equipped with a reboiler that comprises lines 25 and 28 and preheater 26.

Purge gas 6 of column C2 is also recycled in absorber C1 to improve the recovery rate of light hydrocarbons. The residual gas that is low in light hydrocarbons 7 is purged at the top of absorber C1.

The cooling level of cooling systems RF1 and RF2 is adapted to the targeted recovery rate of light hydrocarbons: a preferred temperature range is −35 to +40° C.

This device also allows production of, at the top of absorber C1 via line 7, a gas that is high in hydrogen and low in light hydrocarbons.

In summary, the device according to the invention comprises at least one absorber, at least one separator from which is extracted a gaseous phase that feeds the absorber, at least one recycling to said cold separator of at least a portion of the liquid effluent obtained from the absorber mixed with the feedstock, at least one cooling means of said recycling, at least one means for recovery of a light hydrocarbon-enriched liquid fraction obtained from said cold separator and at least one means for evacuation of gases from the absorber.

Said device can optionally further comprise a fractionation column allowing fractionation of the light hydrocarbon-enriched liquid fraction obtained from the cold separator and at least two fractions.

According to a variant of the process according to the invention, the light hydrocarbon-enriched liquid fraction obtained from the absorber is also partly recovered without being recycled in the cold separator, and optionally the light hydrocarbon-enriched liquid fractions obtained from the absorber and the separator are mixed.

According to a preferred variant, the separator is located under the absorber, and, more preferably, the separator and the absorber consist of two sections superposed inside the same piece of equipment.

The device according to the invention can optionally further comprise a recycling of the liquid fraction obtained from the separator and at least one means for cooling said recycling. In addition, it can optionally further comprise cooling systems.

According to a very preferred variant, said device further comprises a fractionation column allowing fractionation of the liquid effluent obtained from the cold separator into at least 3 fractions, one of which constitutes at least in part the liquid phase recycled to the absorber.

According to another embodiment, said device further comprises at least one exchanger allowing exchange of the calories between the liquid phase obtained from the cold separator and the liquid phase recycled to the absorber after fractionation in the column. It can optionally further comprise at least one pump helping in the recirculation of at least one liquid flow.

The light hydrocarbon-enriched effluent is preferably collected directly at the outlet of the cold separator or optionally at a lateral outlet of the fractionation column, and the purge gas of the column is preferably recycled to the absorber.

Furthermore, the device according to the invention is generally placed downstream from a conversion unit, preferably a unit for hydrogenation, hydrotreatment, hydroconversion, isomerization or cracking. The different variants or embodiments of the device described in this application can optionally advantageously be at least partly combined with one another.

The invention also relates to a process for recovery of a hydrogen-rich gas using the device according to the invention or a process for recovering a hydrocarbon-enriched liquid using said device.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. An apparatus for obtaining a light hydrocarbon enriched liquid fraction comprising means for introducing feedstock at least one absorber (C1) comprising means for withdrawing a liquid effluent (3), at least one cold separator means (D1) for separating a gaseous phase (8) and for feeding the separated gaseous phase (8) to the absorber (C1); means for mixing at least a portion of said withdrawn liquid effluent (3) with feedstock (1), at least one cooling means (RF1) for cooling resultant mixture of said at least one portion of liquid effluent (3) and feedstock (3); at least one means for recycling to said cold separators the resultant cooled mixture containing feedstock and at least a portion of the liquid effluent (3) obtained from the absorber, at least one means for recovery (9, 10) of a light hydrocarbon-enriched liquid fraction obtained from said cold separator and at least one means (7) for evacuation of unabsorbed gases from said at least one absorber (C1).

2. Apparatus according to claim 1, further comprising a fractionation column (C2) for fractionating light hydrocarbon-enriched liquid fraction (10) obtained from cold separator (D1) into at least two fractions and means for transporting said fraction (10) to said fractionation column.

3. Apparatus according to claim 2, further comprising at least one exchanger (E1, E2) for exchanging heat between liquid phase (10) obtained from cold separator (D1) and liquid phase (15) recycled to absorber (C1) after fractionation in column (C2).

4. Apparatus according to claim 3, further comprising means for collecting light hydrocarbon-enriched effluent at a lateral output (22) of fractionation column (C2).

5. Apparatus according claim 2, further comprising means for recycling purge gas (6) from column (C2) to absorber (C1).

6. Apparatus according to claim 1, further comprising means for withdrawing a portion of said light hydrocarbon-enriched liquid fraction (3) obtained from absorber (C1) without being recycled to cold separator (D1).

7. Apparatus according to claim 6, further comprising means for mixing light hydrocarbon-enriched liquid fractions obtained from absorber (C1) and separator (D1).

8. Apparatus according to claim 1, wherein separator (D1) is located under absorber (C1).

9. Apparatus according to claim 1, wherein separator (D1) and absorber (C1) comprise two sections that are superposed inside the same piece of equipment.

10. Apparatus according to claim 1, further comprising means for a recycling liquid fraction (10) obtained from separator (D1) and at least one cooling means (RF2) for cooling recycled liquid fraction.

11. Apparatus according to claim 1, further comprising a fractionation column (C2) for fractionating the liquid effluent obtained from cold separator (D1) into at least 3 fractions (6, 15, 22) of which one (15) constitutes at least partly a liquid phase and means for recycling said liquid phase to absorber (C1).

12. Apparatus according to claim 1, comprising at least one pump (11) for the recirculation of at least one liquid flow.

13. Apparatus according to claim 1, further comprising means for collecting the light hydrocarbon-enriched effluent directly at the outlet of cold separator (D1).

14. Apparatus according to claim 1, further comprising a conversion unit located upstream and in communication with said absorber (C1).

15. Apparatus according to claim 14, in which the conversion unit is a unit for hydrogenation, hydrotreatment, hydroconversion, isomerization or cracking.

16. A process for recovery of a hydrogen-rich gas in apparatus according to claim 1, further comprising means for obtaining a hydrogen rich gas and passing the hydrogen-rich gas as said feedstock into the cold seperator.

17. A process for recovery of a hydrocarbon-enriched liquid in apparatus according to claim 1, further comprising passing said hydrocarbon-enriched liquid as said feedstock into the cold separator.

* * * * *